US009741293B2

(12) United States Patent
Harada et al.

(10) Patent No.: US 9,741,293 B2
(45) Date of Patent: Aug. 22, 2017

(54) DISPLAY DEVICE WITH OPTICAL SEPARATION AND RESPECTIVE LIQUID CRYSTAL PANELS

(71) Applicant: Japan Display Inc., Tokyo (JP)

(72) Inventors: Tsutomu Harada, Tokyo (JP); Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 150 days.

(21) Appl. No.: 14/821,239

(22) Filed: Aug. 7, 2015

(65) Prior Publication Data

US 2016/0093252 A1 Mar. 31, 2016

(30) Foreign Application Priority Data

Sep. 29, 2014 (JP) ..... 2014-198887
Jun. 30, 2015 (JP) ..... 2015-131691

(51) Int. Cl.
*G09G 3/34* (2006.01)

(52) U.S. Cl.
CPC ... *G09G 3/3426* (2013.01); *G09G 2320/0646* (2013.01)

(58) Field of Classification Search
CPC ..... G09G 3/3426; G09G 2320/0646
See application file for complete search history.

(56) References Cited

U.S. PATENT DOCUMENTS 6,219,111 B1 * 4/2001 Fukuda ..... G02B 3/0043 348/E9.027
2004/0189955 A1 * 9/2004 Park ..... G02B 27/48 353/84
2007/0291359 A1 * 12/2007 Ushigome ..... G02B 5/04 359/485.02
2009/0322802 A1 12/2009 Noguchi et al.
2012/0200800 A1 * 8/2012 Kurita ..... G09G 3/3426 349/61
2012/0206501 A1 * 8/2012 Jang ..... G09G 3/342 345/690
2013/0208195 A1 * 8/2013 Cho ..... G02F 1/134309 349/15

FOREIGN PATENT DOCUMENTS

JP 2004-309553 * 4/2004 ..... G02F 1/1347
JP 2004/309553 A 11/2004
JP 2010/033014 A 2/2010

* cited by examiner

*Primary Examiner* — Larry Sternbane

(74) *Attorney, Agent, or Firm* — Michael Best & Friedrich LLP

(57) ABSTRACT

A display device is disclosed. According to one embodiment, the display device includes a light source, a dimming panel and a display panel. The dimming panel includes a dimming area with sub-areas arrayed in a matrix. The dimming panel also controls a transmittance of light from the light source in each of the sub-areas. The display panel includes a display area with pixels arrayed in a matrix and displays an image due to incident light transmitted through the dimming panel thereon. In one example, an optical separation system is arranged between the dimming panel and the display panel. It separates light from the light source into respective wavelength bands. The display panel includes corresponding liquid crystal panels on which the respective wavelength bands are made incident.

8 Claims, 11 Drawing Sheets

DISPLAY DEVICE WITH OPTICAL SEPARATION AND RESPECTIVE LIQUID CRYSTAL PANELS

CROSS-REFERENCE TO RELATED APPLICATIONS

This application is based upon and claims the benefit of priority from Japanese Patent Applications No. 2014-198887, filed Sep. 29, 2014; and No. 2015-131691, filed Jun. 30, 2015, the entire contents of all of which are incorporated herein by reference.

FIELD

Embodiments described herein relate generally to a display device.

BACKGROUND

Currently, a projection display device has been widespread in practical use. In such a display device, not only a bright image, but also a dark image tend to become brighter when the brightness of an image displayed on a screen is enhanced.

Recently, a liquid crystal display device comprising a first liquid crystal panel displaying an image and a second liquid crystal panel uniformly adjusting an amount of light on an entire screen between a light source and the screen has been proposed. In a configuration of uniformly adjusting the amount of light on the entire screen, however, if a bright portion and a dark portion are present together in an image (moving image or still image) displayed on the screen, adjustment of the amount of light in accordance with the brightness at each of the bright portion and the dark portion is difficult.

Thus, there has been a demand for enhancement of the brightness at the bright portion of the image displayed on the screen and a reduction in the brightness at the dark portion to improve the display quality.

DETAILED DESCRIPTION

In general, according to one embodiment, a display device includes: a light source; a dimming panel which comprises a dimming area including sub-areas arrayed in a matrix and controls a transmittance of light from the light source in each of the sub-areas; and a display panel which comprises a display area including pixels arrayed in a matrix and displays an image due to incident light transmitted through the dimming panel thereon.

The embodiments will be described hereinafter with reference to the accompanying drawings. The disclosure is a mere example, and arbitrary change of gist which can be easily conceived by a person of ordinary skill in the art naturally falls within the inventive scope. To more clarify the explanations, the drawings may pictorially show width, thickness, shape, etc., of each portion as compared with an actual aspect, but they are mere examples and do not restrict the interpretation of the invention. In the present specification and drawings, elements like or similar to those in the already described drawings may be denoted by similar reference numbers and their detailed descriptions may be arbitrarily omitted.

Figure 1:
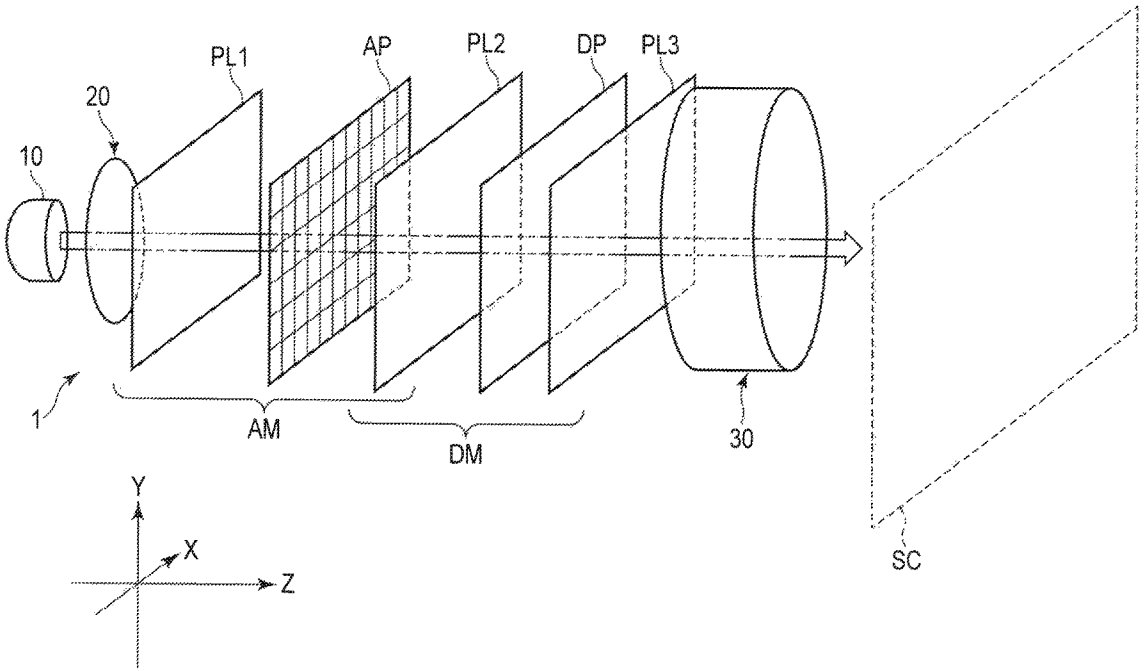
FIG. 1 is a perspective view schematically showing a configuration example of a display device 1 of one of the embodiments.

FIG. 1 is a perspective view schematically showing a configuration example of a display device 1 of one of the embodiments. In the drawing, a first direction X, a second direction Y and a third direction Z are perpendicular to each other.

The display device 1 in the example illustrated is a single-panel type projection display device. The display device 1 comprises a light source 10, a dimming panel AP, a display panel DP, etc. The light source 10 is, for example, a white light source which radiates white light, and is applicable to a high-pressure mercury lamp as an example. The dimming panel AP and the display panel DP are arranged between the light source 10 and a screen SC. If a propagation direction of the light from the light source 10 is parallel to the third direction Z, the dimming panel AP and the display panel DP are arranged in this order along the third direction Z. The dimming panel AP is composed of, for example, a color-filterless liquid crystal panel. The display panel DP is composed of, for example, a liquid crystal panel comprising a color filter. The dimming panel AP and the display panel DP are arranged substantially parallel to an X-Y plane orthogonal to the third direction Z.

The display device 1 further comprises an incident-side optical system 20, a projecting optical system 30, a first polarizer PL1, a second polarizer PL2, a third polarizer PL3, etc. The incident-side optical system 20 is arranged between the light source 10 and the dimming panel AP. The projecting optical system 30 is arranged between the display panel DP and the screen SC. The first polarizer PL1 is arranged between the incident-side optical system 20 and the dimming panel AP. The second polarizer PL2 is arranged between the dimming panel AP and the display panel DP. The third polarizer PL3 is arranged between the display panel DP and the projecting optical system 30.

Each of the incident-side optical system 20 and the projecting optical system 30 is composed of a combination of a plurality of lenses, but the details are not shown. The first polarizer PL1, the dimming panel AP and the second polarizer PL2 may be arranged in an optical path in the incident-side optical system 20 composed of a combination of a plurality of lenses.

In the display device 1, a dimming module AM is composed of the first polarizer PL1, the dimming panel AP and the second polarizer PL2. In addition, a display module DM is composed of the second polarizer PL2, the display panel DP, and the third polarizer PL3. In other words, the second polarizer PL2 has both functions of an analyzer of the dimming module AM and a polarizer of the display module DM.

In the incident-side optical system 20, the light from the light source 10 is made to appropriately diverge and converge and the diverging and converging light is made incident on the dimming module AM. The dimming module AM restricts the amount of light from the light source 10, two-dimensionally, in the first direction X and the second direction Y. The display module DM selectively transmits the light having the amount restricted by means of the dimming module AM to display an image. The projecting optical system 30 appropriately extends the image displayed by the display module DM and projects the image to the screen SC.

Figure 2:
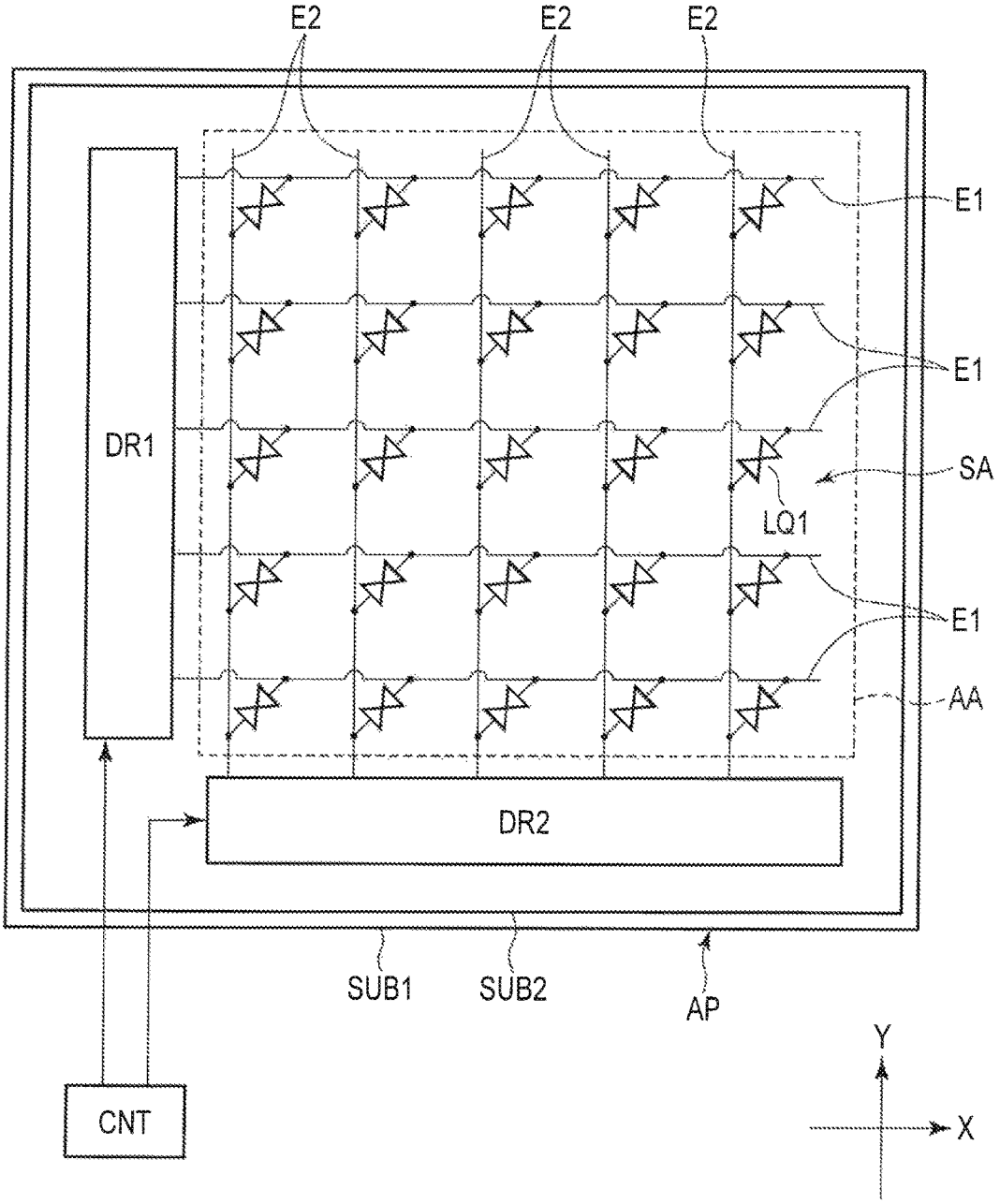
FIG. 2 is a diagram schematically showing a configuration example of the dimming panel AP shown in FIG. 1.

FIG. 2 is a diagram schematically showing a configuration example of the dimming panel AP shown in FIG. 1.

A passive-matrix-driving transmissive liquid crystal panel will be explained as an example of the dimming panel AP. In other words, the dimming panel AP comprises a first substrate SUB1, a second substrate SUB2 opposed to the first substrate SUB1, and a liquid crystal layer LQ1 interposed between the first substrate SUB1 and second substrate SUB2. The first substrate SUB1 and the second substrate SUB2 are bonded to each other with a predetermined cell gap formed therebetween. The dimming panel AP includes a dimming area AA in which the light can be transmitted. The dimming area AA is formed in, for example, a square shape and includes a plurality of sub-areas SA arrayed in a matrix in the first direction X and the second direction Y.

For example, the first substrate SUB1 comprises a plurality of first electrodes E1, and the second substrate SUB2 comprises a plurality of second electrodes E2. The first electrodes E1 and the second electrodes E2 are formed of a transparent conductive material such as indium tin oxide. The first electrodes E1 are formed in a strip shape extended in the first direction X and arranged with approximately constant intervals in the second direction Y intersecting the first direction X, in the dimming area AA. The second electrodes E2 are formed in a strip shape extended in the second direction Y and arranged with approximately constant intervals in the first direction X, in the dimming area AA. The sub-areas SA correspond to respective areas where the first electrodes E1 and the second electrodes E2 intersect through the liquid crystal layer LQ1.

Each of the first electrodes E1 is led to the outside of the dimming area AA and is electrically connected to a first driver DR1. Each of the second electrodes E2 is led to the outside of the dimming area AA and is electrically connected to a second driver DR2. The first driver DR1 and the second driver DR2 are connected to a controller CNT. The controller CNT produces a control signal to control the first driver DR1 and the second driver DR2 as explained later.

Figure 3A:
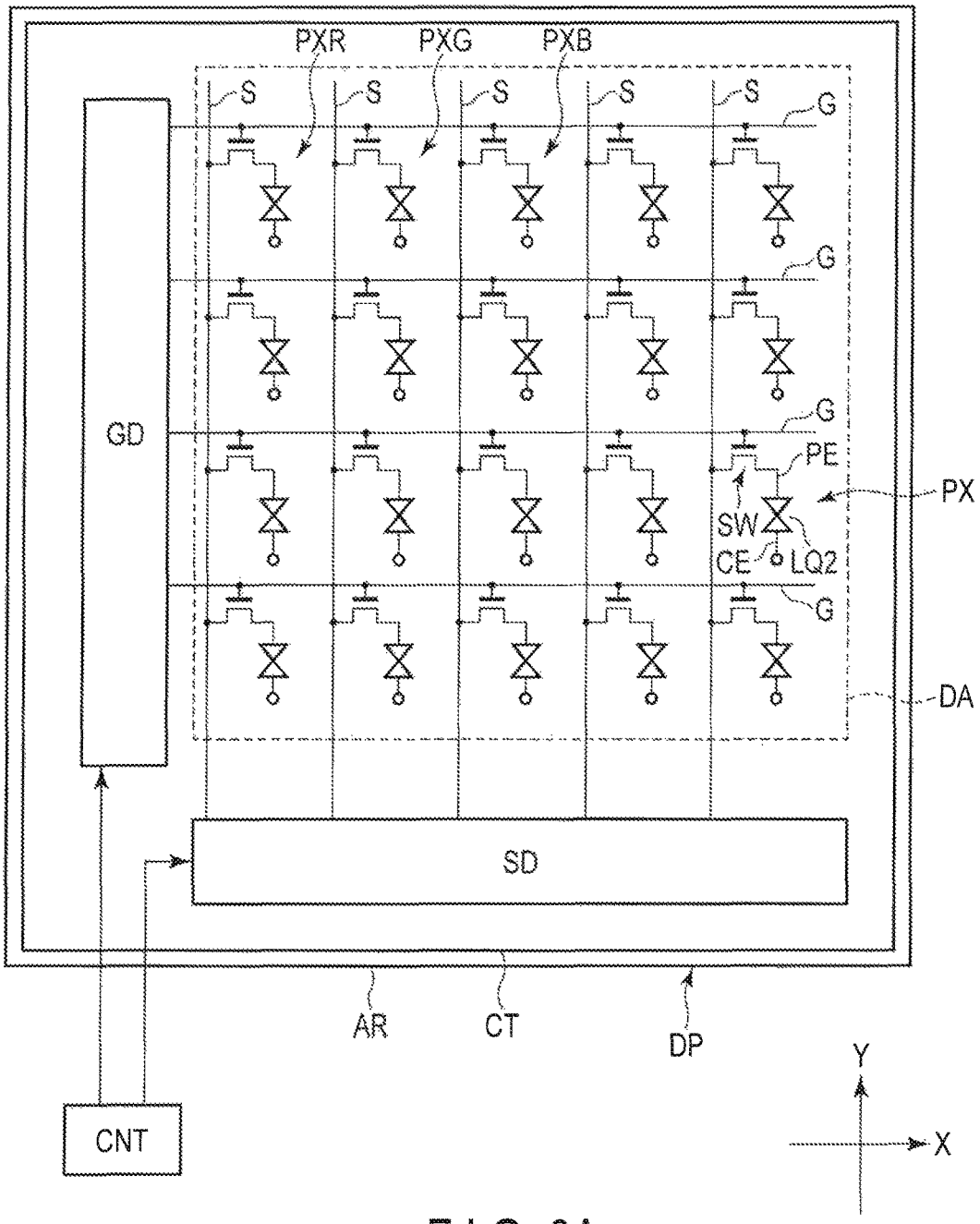
FIG. 3A is a diagram schematically showing a configuration example of the display panel DP shown in FIG. 1.

FIG. 3A is a diagram schematically showing a configuration example of the display panel DP shown in FIG. 1.

An active-matrix-driving transmissive liquid crystal panel will be explained as an example of the display panel AP. In other words, the display panel DP comprises an array substrate AR, a counter-substrate CT opposed to the array substrate AR, and a liquid crystal layer LQ2 interposed between the array substrate AR and the counter-substrate CT. The array substrate AR and the counter-substrate CT are bonded to each other with a predetermined cell gap formed therebetween. The display panel DP includes a display area DA where an image is displayed. The display area DA is formed in, for example, a square shape, and includes a plurality of pixels PX arrayed in a matrix.

The display area DA includes, for example, a red pixel PXR, a green pixel PXG and a blue pixel PXB as the pixels PX. It should be noted that the display area DA may further include a pixel of a color different from red, green and blue (for example, a white pixel). The red pixel PXR comprises a red color filter and is formed to transmit red light, primarily, of the white light from the light source 10. The green pixel PXG comprises a green color filter and is formed to transmit green light, primarily, of the white light from the light source 10. The blue pixel PXB comprises a blue color filter and is formed to transmit blue light, primarily, of the white light from the light source 10. The color filters may be formed on the array substrate AR or the counter-substrate CT, though not explained in detail.

The array substrate AR comprises a plurality of gate lines G extended along the first direction X and a plurality of source lines S extended along the second direction Y to cross the gate lines G. Each of the gate lines G is led to the outside of the display area DA and is connected to a gate driver GD. Each of the source lines S is led to the outside of the display area DA and is connected to a source driver SD. The gate driver GD and the source driver SD are connected to the controller CNT. The controller CNT produces a control signal to control the gate driver GD and the source driver SD as explained later.

Each of the pixels PX comprises a switching element SW (for example, thin-film transistor), a pixel electrode PE, a common electrode CE, etc. The switching element SW is electrically connected to gate line G and the source line S. The pixel electrode PE is electrically connected to the switching element SW. A common electrode CE is opposed to each pixel electrode PE. Explanation of the detailed configuration of the display panel DP is omitted here but, in a mode of primarily utilizing a longitudinal electric field along a normal direction of the display panel DP, the common electrode CE is disposed on the counter-electrode CT while the pixel electrode PE is disposed on the array substrate AR. In addition, in a mode of primarily utilizing a lateral electric field along the in-plane of the display panel DP, both the pixel electrode PE and the common electrode CE are disposed on the array substrate AR.

The mode of utilizing the longitudinal electric field is, for example, a twisted nematic (TN) mode, a polymer dispersed liquid crystal (PDLC) mode, an optically compensated bend (OCB) mode, an electrically controlled birefringence (ECB) mode, or a vertical aligned (VA) mode. In addition, the mode of utilizing the lateral electric field is, for example, a fringe field switching (FFS) mode, an in-plane switching (IPS) mode or the like.

Figure 3B:
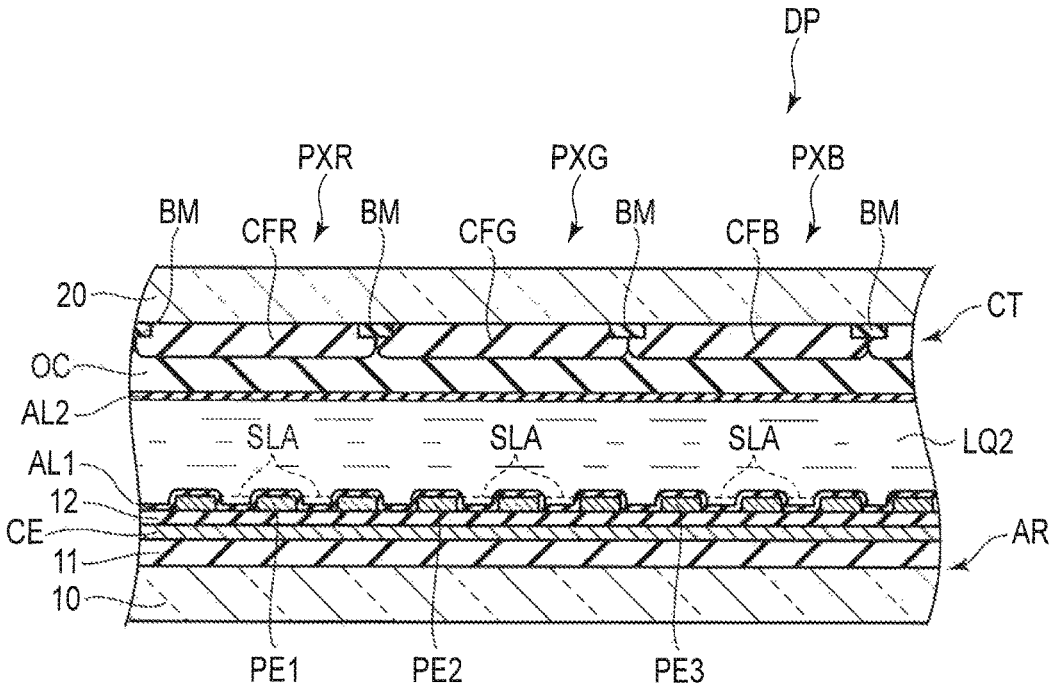
FIG. 3B is a cross-sectional view showing the configuration example in part of the display panel DP shown in FIG. 1.

FIG. 3B is a cross-sectional view showing the configuration example in part of the display panel DP shown in FIG. 1. A cross-sectional structure of the display panel DP in the FFS mode will be briefly explained here.

The array substrate AR comprises a first insulating substrate 10, a first insulating film 11, a common electrode CE, a second insulating film 12, pixel electrodes PE1, PE2 and PE3, a first alignment film AL1, etc. The common electrode CE is extended over the red pixel PXR, the green pixel PXG and the blue pixel PXB. Each of the pixel electrode PE1 of the red pixel PXR, the pixel electrode PE2 of the green pixel PXG, and the pixel electrode PE3 of the blue pixel PXB is opposed to the common electrode CE and comprises a slit SLA.

A counter-substrate CT comprises a second insulating substrate 20, a light-shielding layer BM, color filters CFR, CFG and CFB, an overcoat layer OC, a second alignment film AL2, etc. The color filters CFR, CFG and CFB are opposed to the pixel electrodes PE1, PE2 and PE3, respectively, through a liquid crystal layer LQ2. The color filter CFR is a red color filter, the color filter CFG is a green color filter, and the color filter CFB is a blue color filter.

The liquid crystal layer LQ2 is sealed between the first alignment film AL1 and the second alignment film AL2.

The color filters CFR, CFG and CFB are formed in the counter-substrate CT in the example illustrated, but may be formed in the array substrate AR.

Figure 4:
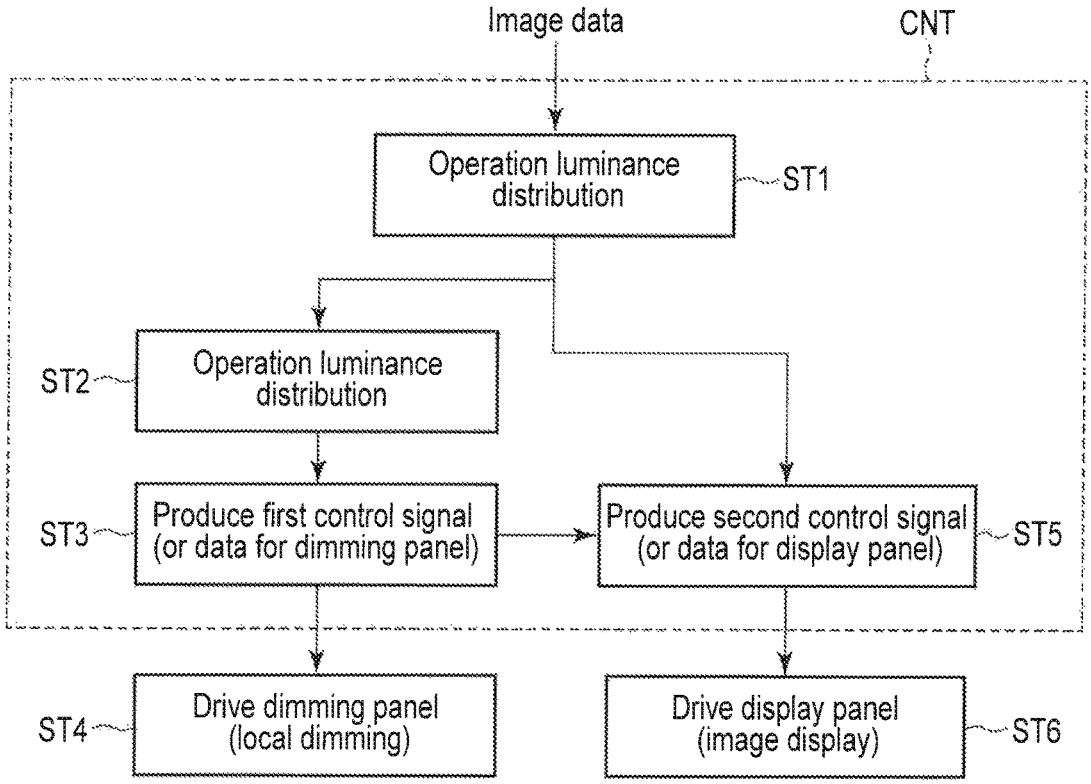
FIG. 4 is a block diagram schematically showing a control example of the controller CNT in the display device 1 of the embodiment.

FIG. 4 is a block diagram schematically showing a control example of the controller CNT in the display device 1 of the embodiment.

The controller CNT sequentially receives elements of image data for one frame to be displayed on the display area DA from an external electronic device connected to the display device 1. The image data includes, for example, the color, the luminance, etc., to be displayed on each pixel PX of the display area DA. The controller CNT analyzes the received image data and operates a luminance distribution of the image data (ST1). Then, the controller CNT produces control signals to control the dimming panel AP and the display panel DP, respectively.

First, a process of producing a first control signal to control the dimming panel AP will be explained. The controller CNT operates the luminance distribution corresponding to the definition of the dimming panel AP, based on the luminance distribution of the image data (ST2). For example, the definition of the dimming panel AP is lower than the definition of the display panel DP and the size of each sub-area SA is larger than the size of each pixel PX of the display panel DP. In other words, a plurality of pixels PX are opposed to the single sub-area SA. For this reason, the luminance of the single sub-area SA is operated based on the luminance of the plurality of opposed pixels PX.

Then, the controller CNT produces the first control signal to control each sub-area SA on the dimming panel AP. The controller CNT determines a transmittance of each sub-area SA and produces the first control signal (or data for the dimming panel) corresponding to the determined transmittance, based on the luminance distribution operated in step ST2 (ST3). Then, the controller CNT supplies the produced first control signal to the first driver DR1 and the second driver DR2.

Then, the dimming panel AP is driven based on the first control signal supplied from the controller CNT (ST4). In other words, the first driver DR1 sequentially selects the first electrodes E1, based on the first control signal. In addition, the second driver DR2 applies a voltage to each of the second electrodes E2 corresponding to the respective sub-areas SA when the first electrodes E1 are selected, based on the first control signal. The voltage applied to the second electrodes E2 is selected so as to obtain a desired transmittance in the sub-area SA. The voltage corresponding to the potential difference between the first electrode E1 and the second electrode E2 is thereby applied to the liquid crystal layer LQ1 in each sub-area SA. The liquid crystal layer LQ1 is modulated in accordance with the applied voltage. The transmittance in each of the matrix-arrayed sub-areas SA is thus controlled on the dimming panel AP (local dimming).

As the voltage applied to the second electrode E2, at least two values may be prepared to set each sub-area SA in a transmitted state (white-display state) or a non-transmitted state (black-display state), but a voltage value corresponding to a plurality of gradations may also be prepared to set each sub-area SA in a halftone display state.

Next, a process of producing a second control signal to control the display panel DP will be explained. The controller CNT produces the second control signal to control each of the pixels PX on the display panel DP, based on the luminance distribution of the image data operated in step ST1. More specifically, the controller CNT determines a transmittance of each of the pixels PX on the display panel DP and produces the second control signal (or data for the display panel) corresponding to the determined transmittance, based on the luminance distribution of the image data (ST5). At this time, the controller CNT produces the second control signal for the display panel, based on the first control signal for the dimming panel produced in step ST3, to correct the difference in definition between the dimming panel AP and the display panel DP. The controller CNT supplies the produced second control signal to the gate driver GD and the source driver SD.

The display panel DP is driven based on the second control signal supplied from the controller CNT (ST6). In other words, the gate driver GD sequentially selects the gate lines G, based on the second control signal supplies from the controller CNT. The source driver SD supplies a video signal to each source line S, based on the second control signal supplied from the controller CNT. In each pixel PX, the video signal supplied to the source line S is written to the pixel electrode PE via the switching element SW changed to be in a conductive state based on the selection of each gate line G. The voltage corresponding to the potential difference between the pixel electrode PE and the common electrode CE is thereby applied to the liquid crystal layer LQ2 in each pixel PX. The liquid crystal layer LQ2 is modulated in accordance with the applied voltage. The transmittance in each of the matrix-arrayed pixels PX is thus controlled on the display panel DP (image display).

Figure 5:
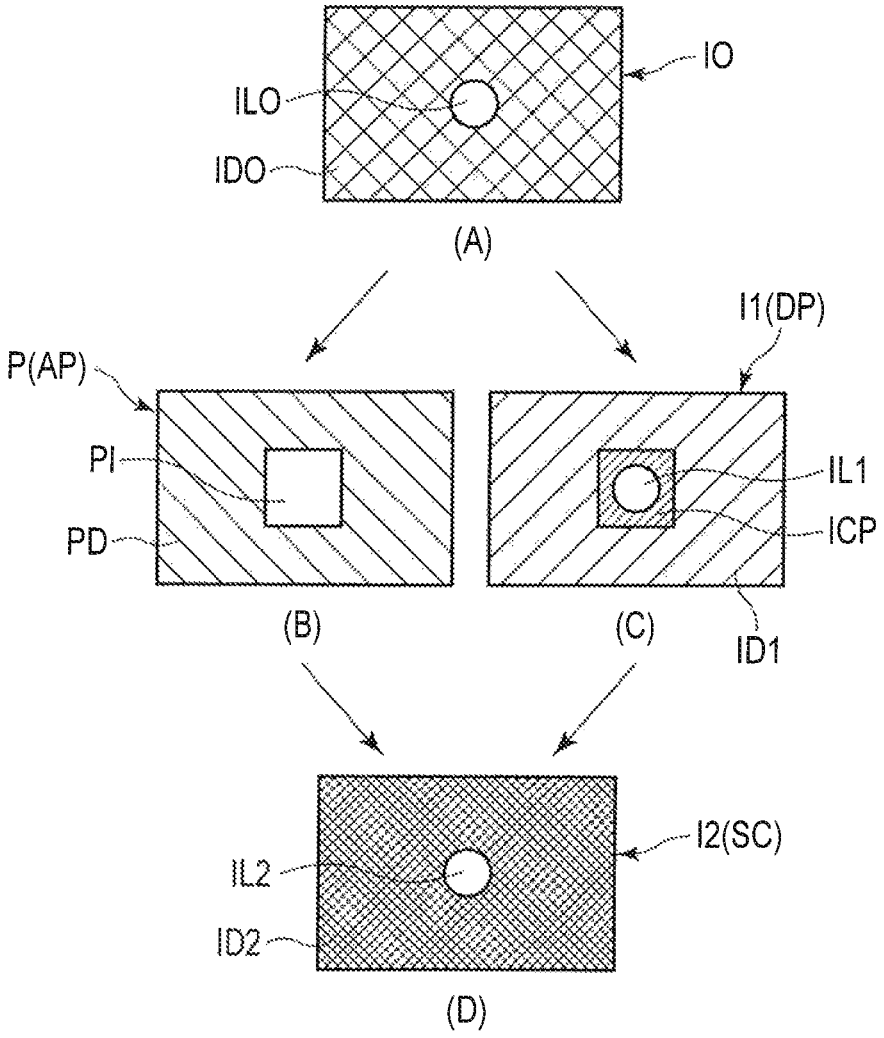
FIG. 5 illustrates an example of the display image displayed by the display device 1 of the embodiment.

FIG. 5 illustrates an example of the display image displayed by the display device 1 of the embodiment.

FIG. 5(A) shows an original image 10 which should be displayed based on the image data received from the outside. The original image I0 includes a bright portion IL0 of a comparatively high luminance and a dark portion ID0 of a comparatively low luminance.

FIG. 5(B) shows a dimming pattern P formed in a dimming area AA of the dimming panel AP based on the data for the dimming panel. The dimming pattern P includes a bright pattern PI formed in an area including the bright portion IL0 of the original image I0 and a dark pattern PD formed in an area corresponding to the dark portion ID0 of the original image 10. A transmittance of the bright pattern PI is higher than a transmittance of the dark pattern PD. In the example illustrated, the bright pattern PI is formed in an area larger than the bright portion IL0 since the definition of the dimming panel AP is lower than the definition of the display panel DP and since the size of the sub-area SA is larger than the size of the pixel PX. It should be noted that the dimming pattern P may include an area (gradation pattern) in which the transmittance is varied step by step, between the bright pattern PI and the dark pattern PD.

FIG. 5(C) shows a display image I1 displayed in the display area DA of the display panel DP based on the data for the display panel. The display image I1 includes a bright portion IL1 displayed in the area corresponding to the bright portion IL0 of the original image I0 and a dark portion ID1 displayed in an area corresponding to the dark portion ID0 of the original image 10. A transmittance of the bright portion IL1 is higher than a transmittance of the dark portion ID1. In addition, in the example illustrated, the display image I1 includes a complementary portion ICP between the bright portion IL1 and the dark portion ID1 since the bright pattern PI of the dimming pattern P is formed in an area larger than the bright portion IL0 of the original image 10. The complementary portion ICP and the bright portion IL1 are formed at positions corresponding to the bright pattern PI. The dark portion ID1 is formed at a position corresponding to the dark pattern PD. A first boundary between the complementary portion ICP and the dark portion ID1 substantially matches a second boundary between the bright pattern PI and the dark pattern PD. If a magnification of the display image I1 to the dimming pattern P is not one, the first boundary often does not match the second boundary, but the first boundary and the second boundary are similar figures to each other. A transmittance (or luminance) of the complementary portion ICP is set such that even light transmitted through the bright pattern PI is displayed with the same luminance as the dark portion ID0 of the original image 10. For example, the transmittance of the complementary portion ICP is set to be lower than the transmittance of the dark portion ID1.

FIG. 5(D) shows a display image 12 displayed on a screen SC through the dimming panel AP and the display panel DP. The display image 12 includes a bright portion IL2 displayed in the area corresponding to the bright portion IL0 of the original image I0 and a dark portion ID2 displayed in an area corresponding to the dark portion ID0 of the original image 10. The bright portion IL2 is displayed through the bright pattern PI of the dimming panel AP and the bright portion IL1 of the display panel DP. For this reason, the bright portion IL2 is displayed at a comparatively high luminance. In contrast, a substantially entire area of the dark portion ID2 is displayed through the dark pattern PD of the dimming panel AP and the dark portion ID1 of the display panel DP. At this time, the amount of the light transmitted through the dark pattern PD is sufficiently reduced since the dark pattern PD of the dimming panel AP adequately shields the light from the light source 10. The dark portion ID1 overlapping such a dark pattern PD is displayed at a sufficiently low luminance. A portion between the bright pattern PI of the dimming pattern P and the bright portion IL1 of the display panel DP is complemented by the complementary portion ICP and is displayed at the luminance corresponding to the original image 10.

According to the above-explained present embodiment, the transmittance of the light from the light source 10 is controlled for each of the sub-areas SA arrayed in a matrix. Control of the transmittance can be implemented by the dimming panel AP configured to two-dimensionally restrict the amount of the light from the light source 10 in accordance with the luminance distribution of the original image. For this reason, when the bright portion and the dark portion are present together in the image displayed on the screen SC, the dark portion can be displayed with a sufficiently low luminance while displaying the bright portion with a high luminance, and the contrast ratio can be enhanced. In other words, the brightness and the darkness are distinguishable in the image displayed on the screen SC and the display quality can be improved.

In addition, the dimming panel AP is not required to have the definition to the same level as the display panel DP and can be constituted by an inexpensive color-filterless liquid crystal panel. For this reason, increase in manufacturing costs of the display device can be suppressed.

In addition, a structure of the dimming panel AP similar to a passive liquid crystal panel is simple and the dimming panel AP can easily be manufactured at low cost. A liquid crystal panel of, for example, a TN mode or PDLC mode can be employed as the passive liquid crystal panel.

In addition, if both the dimming panel AP and the display panel DP are constituted by liquid crystal panels, a polarizer arranged between the dimming panel AP and the display panel DP has both a function of a polarizer constituting the dimming module and a function of a polarizer constituting the display module. For this reason, the number of components necessary for the display device can be reduced.

In addition, if an optical path length from the dimming panel AP to the display panel DP is comparatively long, influence of displacement of the display panel DP from the dimming panel AP can be reduced by controlling the transmittance such that the dimming pattern on the dimming panel AP has a gradation pattern between the bright pattern and the dark pattern.

In the above-explained embodiment, too, the dimming panel AP may be constituted by an active matrix driving liquid crystal panel. Liquid crystal panels of various active matrix types such as an FFS mode, an IPS mode, a TN mode, a PDLC mode, an OCB mode, an ECB mode and a VA mode can be applied as the dimming panel AP. In addition, the dimming panel AP may have an equivalent definition as the display panel DP. The dimming panel AP may be constituted by a panel utilizing a microelectromechanical system, a panel utilizing electrochromism, etc.

The display panel DP may also be constituted by a reflective liquid crystal panel. Since the reflective liquid crystal panel can secure an area contributing to display irrespective of an installation area of wirings and switching elements, the panel can increase a display area per pixel as compared with a transmissive liquid crystal display panel.

Next, another configuration example of the present embodiment will be described. The display device 1 explained below is a triple-panel type projection display device.

Figure 6:
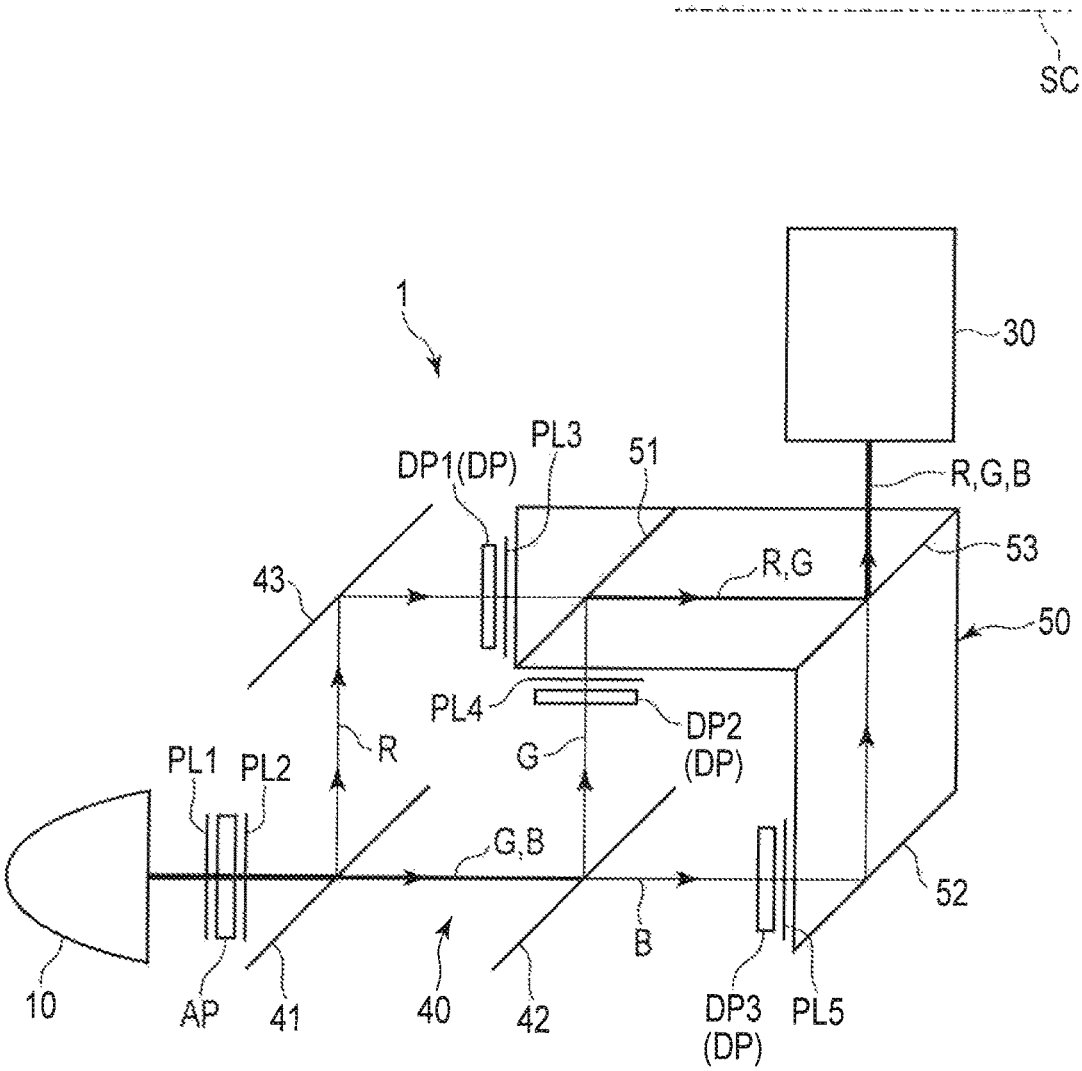
FIG. 6 is an illustration schematically showing another configuration example of the display device 1 of the embodiment.

FIG. 6 is an illustration schematically showing another configuration example of the display device 1 of the embodiment.

The display device 1 comprises a light source 10, a projecting optical system 30, an optical separation system 40, an optical synthesis system 50, a dimming panel AP, the display panel DP, first to fifth polarizers PL1 to PL5, etc. The display device 1 also comprises an incident-side optical system between the light source 10 and the optical separation system 40 though not shown in the drawing. The light source, the incident-side optical system, the projecting optical system, and the dimming panel having substantially the same structures as those shown in FIG. 1 can be applied as the light source 10, the incident-side optical system, the projecting optical system 30, and the dimming panel AP.

The optical separation system 40 is arranged between the dimming panel AP and the display panel DP. The optical separation system 40 separates the light from the light source 10 into a first wavelength band (for example, a red wavelength band), a second wavelength band (for example, a green wavelength band) shorter than the first wavelength band, and a third wavelength band (for example, a blue wavelength band) shorter than the second wavelength band.

For example, the optical separation system 40 comprises a dichroic mirror 41, a dichroic mirror 42, a mirror 43, etc. The dichroic mirror 41 reflects light of the first wavelength band and transmits light of a wavelength shorter than the first wavelength band. The dichroic mirror 42 reflects light of the second wavelength band, of the light transmitted through the dichroic mirror 41, and transmits light of a wavelength shorter than the second wavelength band.

The display panel DP comprises a first liquid crystal panel DP1, a second liquid crystal panel DP2, and a third liquid crystal panel DP3. Each of the first liquid crystal panel DP1, the second liquid crystal panel DP2, and the third liquid crystal panel DP3 is a color-filterless transmissive liquid crystal panel. The light of the first wavelength band reflected by the dichroic mirror 41 and the mirror 43 is made incident on the first liquid crystal panel DP1. The light of the second wavelength band transmitted through the dichroic mirror 41 and reflected by the dichroic mirror 42 is made incident on the second liquid crystal panel DP2. The light of the third wavelength band transmitted through the dichroic mirror 41 and the dichroic mirror 42 is made incident on the third liquid crystal panel DP3.

The first polarizer PL1 is arranged between the light source 10 and the dimming panel AP. The second polarizer PL2 is arranged between the dimming panel AP and the optical separation system 40. The third polarizer PL3 is arranged between the first liquid crystal panel DP1 and the optical synthesis system 50. The fourth polarizer PL4 is arranged between the second liquid crystal panel DP2 and the optical synthesis system 50. The fifth polarizer PL5 is arranged between the third liquid crystal panel DP3 and the optical synthesis system 50.

The optical synthesis system 50 is arranged between the display panel DP and the projecting optical system 30. The optical synthesis system 50 synthesizes a first image of the first wavelength band displayed by the first liquid crystal panel DP1 and the third polarizer PL3, a second image of the second wavelength band displayed by the second liquid crystal panel DP2 and the fourth polarizer PL4, and a third image of the third wavelength band displayed by the third liquid crystal panel DP3 and the fifth polarizer PL5. For example, the optical synthesis system 50 is composed of a dichroic prism. A reflective surface 51 transmits the light of the first wavelength band and reflects the light of the second wavelength band to synthesize the first image and the second image. A reflective surface 52 reflects the light of the third wavelength band. A reflective surface 53 reflects the light of the first wavelength band and the second wavelength band and transmits the light of the third wavelength band to synthesize the first image, the second image, and the third image.

The projecting optical system 30 is arranged between the optical synthesis system 50 and the screen SC to project the image synthesized by the optical synthesis system 50 onto the screen SC.

In such a configuration example, too, the amount of the light from the light source is two-dimensionally restricted on the dimming panel in accordance with the luminance distribution of the original image. For this reason, the contrast ratio of the image displayed on the screen can be improved and the display quality can be improved. In addition, since the display panel of the triple-panel type projection display device is color-filterless panel as compared with the single-panel type projection display device, the efficiency of use of the light from the light source becomes higher and the luminance can be made higher.

Figure 7:
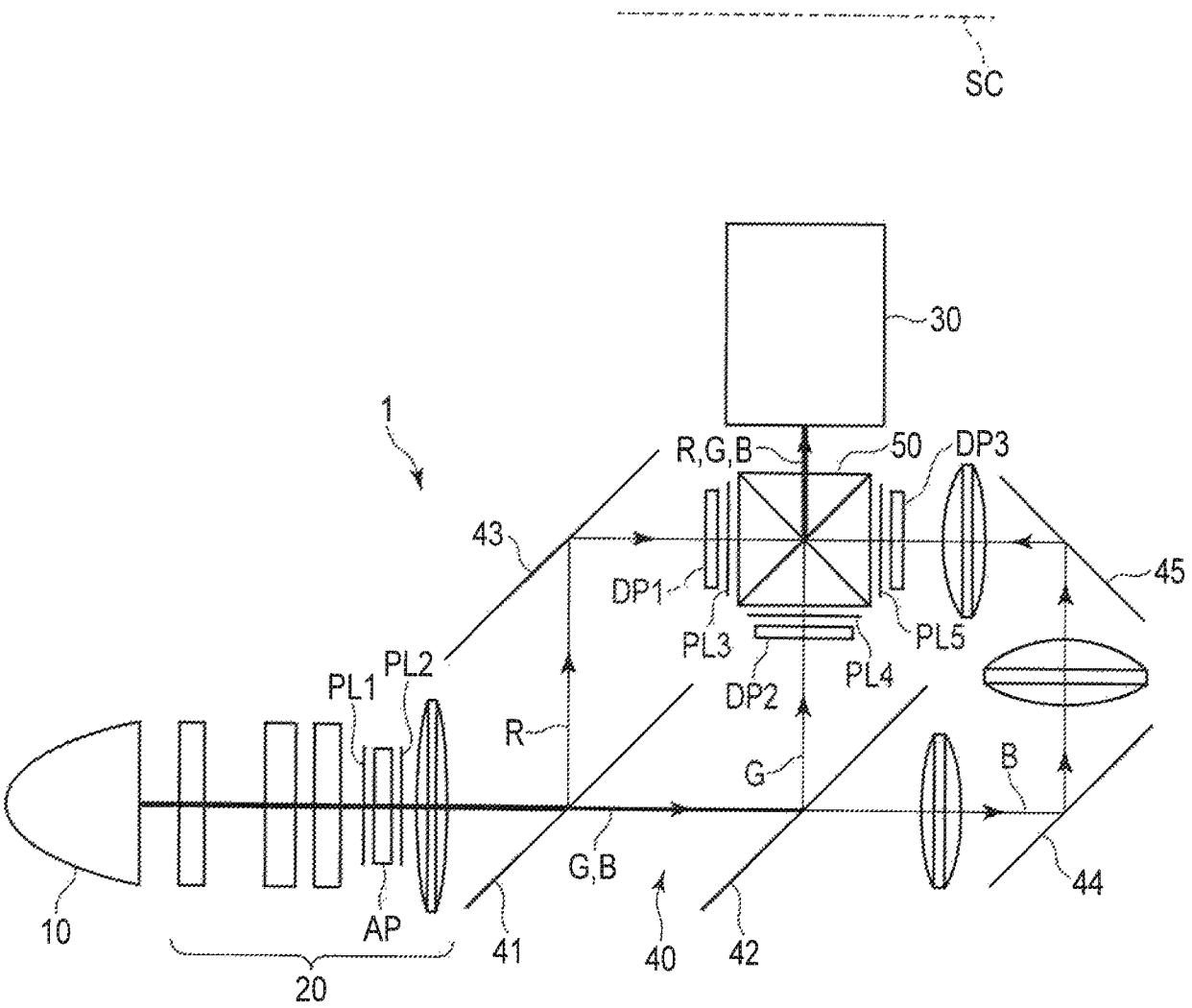
FIG. 7 is an illustration schematically showing another configuration example of the display device 1 of the present embodiment.

FIG. 7 is an illustration schematically showing another configuration example of the display device 1 of the present embodiment.

The configuration example shown in FIG. 7 is different from the configuration example in FIG. 6 with respect to a feature that the optical synthesis system 50 is composed of a cross dichroic prism.

In other words, the display device 1 comprises the light source 10, the incident-side optical system 20, the projecting optical system 30, the optical separation system 40, the optical synthesis system 50, the dimming panel AP, the first to third liquid crystal panels DP1 to DP3, the first to fifth polarizers PL1 to PL5, etc. The first polarizer PL1, the dimming panel AP and the second polarizer PL2 may be arranged in an optical path in the incident-side optical system 20 as shown in the drawing, but may be arranged between the incident-side optical system 20 and the optical separation system 40. The difference from the configuration example in FIG. 6 will be primarily explained below.

The separation optical system 40 further comprises a mirror 44 and a mirror 45 besides the dichroic mirror 41, the dichroic mirror 42, and the mirror 43. The mirror 44 and the mirror 45 reflect the light of the third wavelength band transmitted through the dichroic mirror 41 and the dichroic mirror 42, toward the third liquid crystal panel DP3.

The optical synthesis system 50 synthesizes the first image of the first wavelength band displayed by the first liquid crystal panel DP1 and the third polarizer PL3, the second image of the second wavelength band displayed by the second liquid crystal panel DP2 and the fourth polarizer PL4, and the third image of the third wavelength band displayed by the third liquid crystal panel DP3 and the fifth polarizer PL5.

In this configuration example, too, the same advantages as those of the configuration example shown in FIG. 6 can be obtained.

Figure 8:
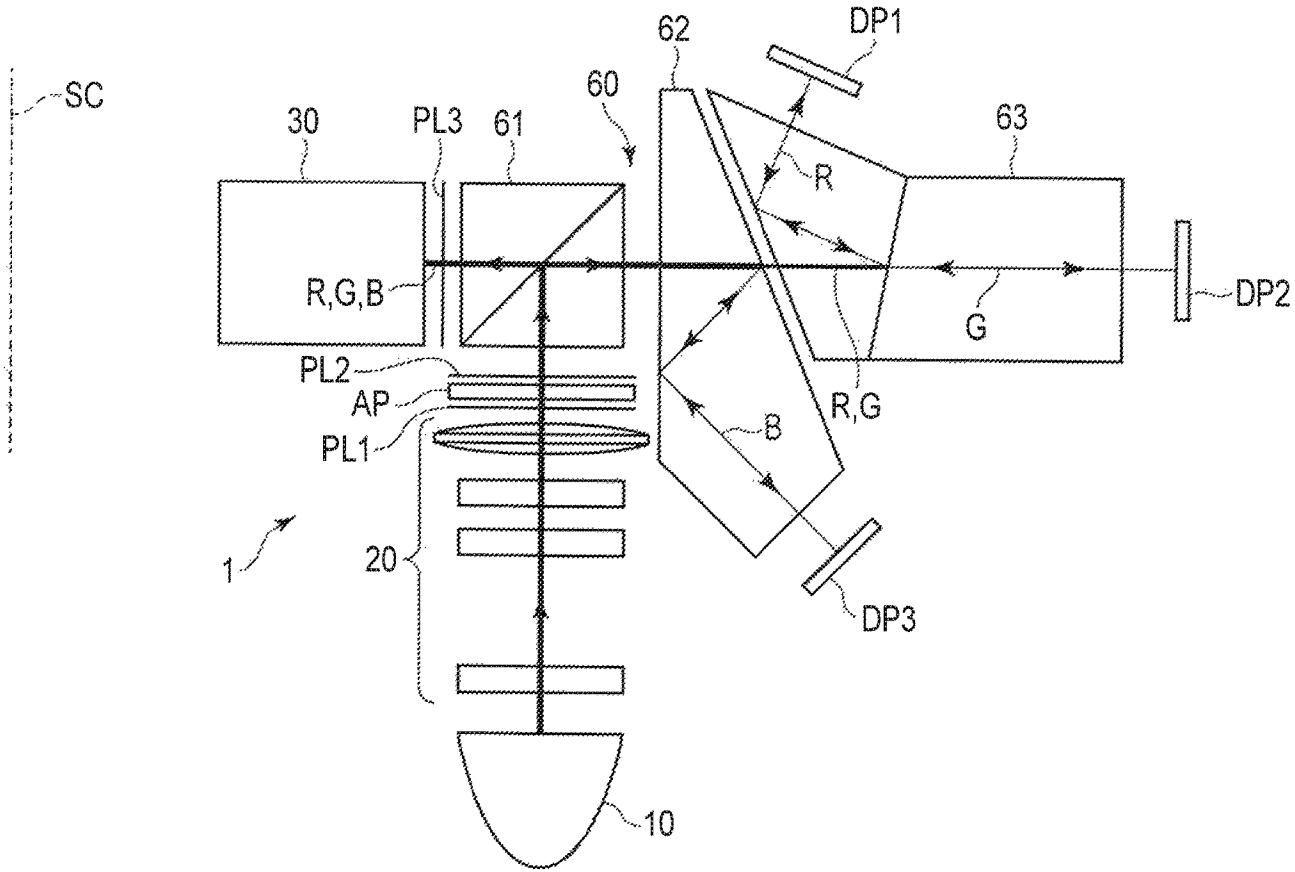
FIG. 8 is an illustration schematically showing another configuration example of the display device 1 of the embodiment.

FIG. 8 is an illustration schematically showing another configuration example of the display device 1 of the embodiment.

The configuration example shown in FIG. 8 is different from each of the above-explained configuration examples with respect to features that each of the first to third liquid crystal panels DP1 to DP3 is a color-filterless reflective liquid crystal panel and that an optical color separation/synthesis system 60 is applied.

The display device 1 comprises the light source 10, the incident-side optical system 20, the projecting optical system 30, the optical color separation/synthesis system 60, the dimming panel AP, the first to third liquid crystal panels DP1 to DP3, the first to third polarizers PL1 to PL3, etc. The first polarizer PL1, the dimming panel AP and the second polarizer PL2 may be arranged between the incident-side optical system 20 and the optical color separation/synthesis system 60 as shown in the drawing, but may be arranged in the optical path in the incident-side optical system 20.

The optical color separation/synthesis system 60 comprises a first optical system 61, a second optical system 62, a third optical system 63, etc. The first optical system 61 is composed of, for example, a polarizing beam splitter. The first optical system 61 reflects the light transmitted from the light source 10 through the incident-side optical system 20, the first polarizer PL1, the dimming panel AP and the second polarizer PL2, toward the second optical system 62 and the third optical system 63, while transmitting the light reflected through the second optical system 62 and the third optical system 63 toward the projecting optical system 30. The second optical system 62 transmits the light of the first wavelength band (for example, red wavelength band) and the second wavelength band (for example, green wavelength band), of the light reflected by the first optical system 61, while reflecting the light of the third wavelength band (for example, blue wavelength band) toward the third liquid crystal panel DP3. The third optical system 63 separates the light of the first wavelength band, of the light transmitted through the second optical system 62, and reflects the light toward the first liquid crystal panel DP1, and separates the light of the second wavelength band and reflects the light toward the second liquid crystal panel DP2. In the second optical system 62 and the third optical system 63, the light reflected from the first to third liquid crystal panels DP1 to DP3 is synthesized after passing through the same optical path as the light incident on the first to third liquid crystal panels DP1 to DP3.

In this configuration example, too, the same advantages as those of the above-described configuration examples can be obtained.

Figure 9:
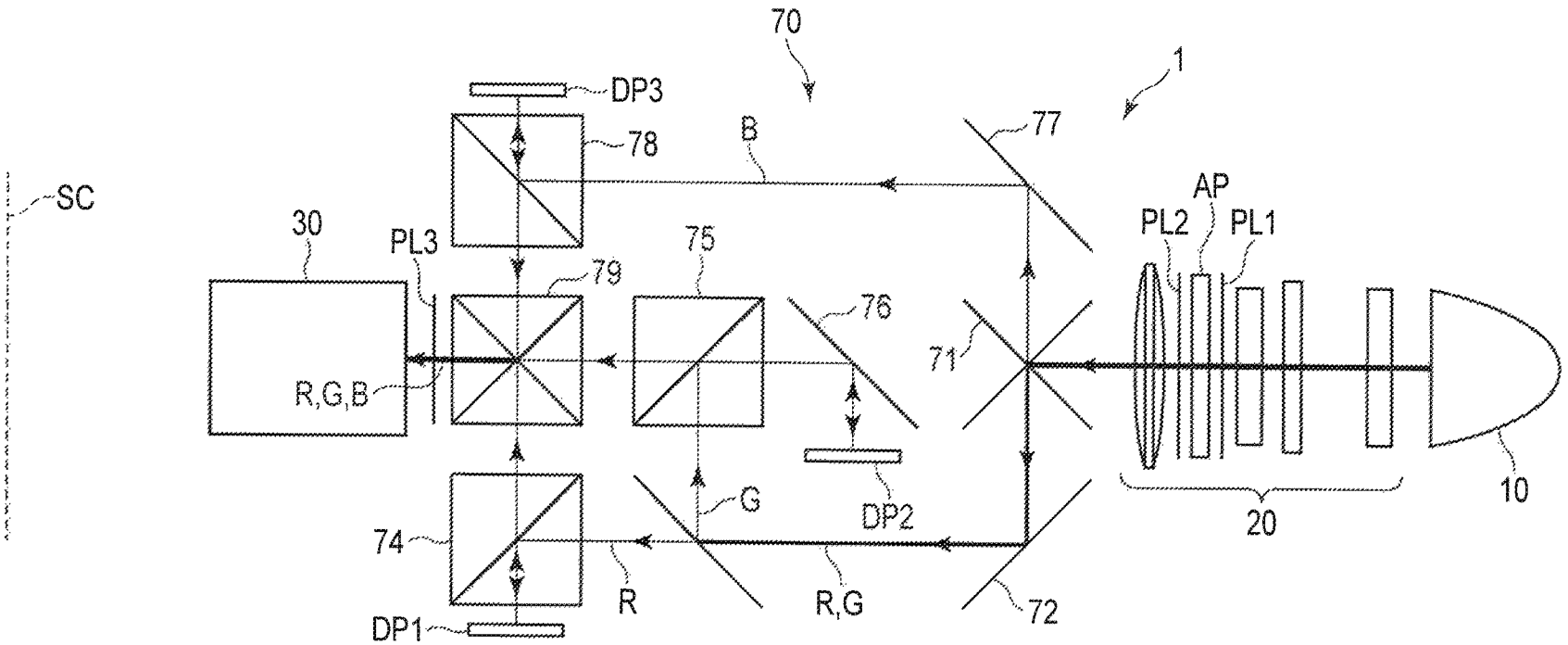
FIG. 9 is an illustration schematically showing another configuration example of the display device 1 of the embodiment.

FIG. 9 is an illustration schematically showing another configuration example of the display device 1 of the embodiment.

The configuration example shown in FIG. 9 is different from the configuration example in FIG. 8 with respect to a feature that an optical color separation/synthesis system 70 comprising a cross dichroic prism is applied.

The display device 1 comprises the light source 10, the incident-side optical system 20, the projecting optical system 30, the optical color separation/synthesis system 70, the dimming panel AP, the first to third liquid crystal panels DP1 to DP3, the first to third polarizers PL1 to PL3, etc. The first polarizer PL1, the dimming panel AP and the second polarizer PL2 may be arranged in an optical path in the incident-side optical system 20 as shown in the drawing, but may be arranged between the incident-side optical system 20 and the optical separation system 40.

For example, the optical color separation/synthesis system 70 comprises a beam splitter 71, a mirror 72, a dichroic mirror 73, a polarizing beam splitter 74, a polarizing beam splitter 75, a mirror 76, a mirror 77, a polarizing beam splitter 78, and a cross dichroic prism 79.

The beam splitter 71 reflects toward the mirror 72 the light of the first wavelength band (for example, red wavelength band) and the second wavelength band (for example, green wavelength band), of the light transmitted from the light source 10 through the incident-side optical system 20, the first polarizer PL1, the dimming panel AP and the second polarizer PL2, while reflecting the light of the third wavelength band (for example, blue wavelength band) toward the mirror 77.

The dichroic mirror 73 transmits the light of the first wavelength band, of the light reflected by the mirror 72, while reflecting the light of the second wavelength band.

The polarizing beam splitter 74 reflects the light of the first wavelength band transmitted through the dichroic mirror 73, toward the first liquid crystal panel DP1, while transmitting the light reflected from the first liquid crystal panel DP1. The polarizing beam splitter 75 reflects the light of the second wavelength band reflected by the dichroic mirror 73, toward the second liquid crystal panel DP2 through the mirror 76, while transmitting the light reflected from the second liquid crystal panel DP2. The polarizing beam splitter 78 reflects the light of the third wavelength band reflected by the mirror 77, toward the third liquid crystal panel DP3, while transmitting the light reflected from the third liquid crystal panel DP3.

The cross dichroic prism 79 reflects each of the light transmitted through the polarizing beam splitter 74 and the light transmitted through the polarizing beam splitter 78, toward the projecting optical system 30 through the third polarizer PL3, and transmits the light transmitted through the polarizing beam splitter 75 toward the projecting optical system 30 through the third polarizer PL3.

In this configuration example, too, the same advantages as those of the above-described configuration examples can be obtained.

Figure 10:
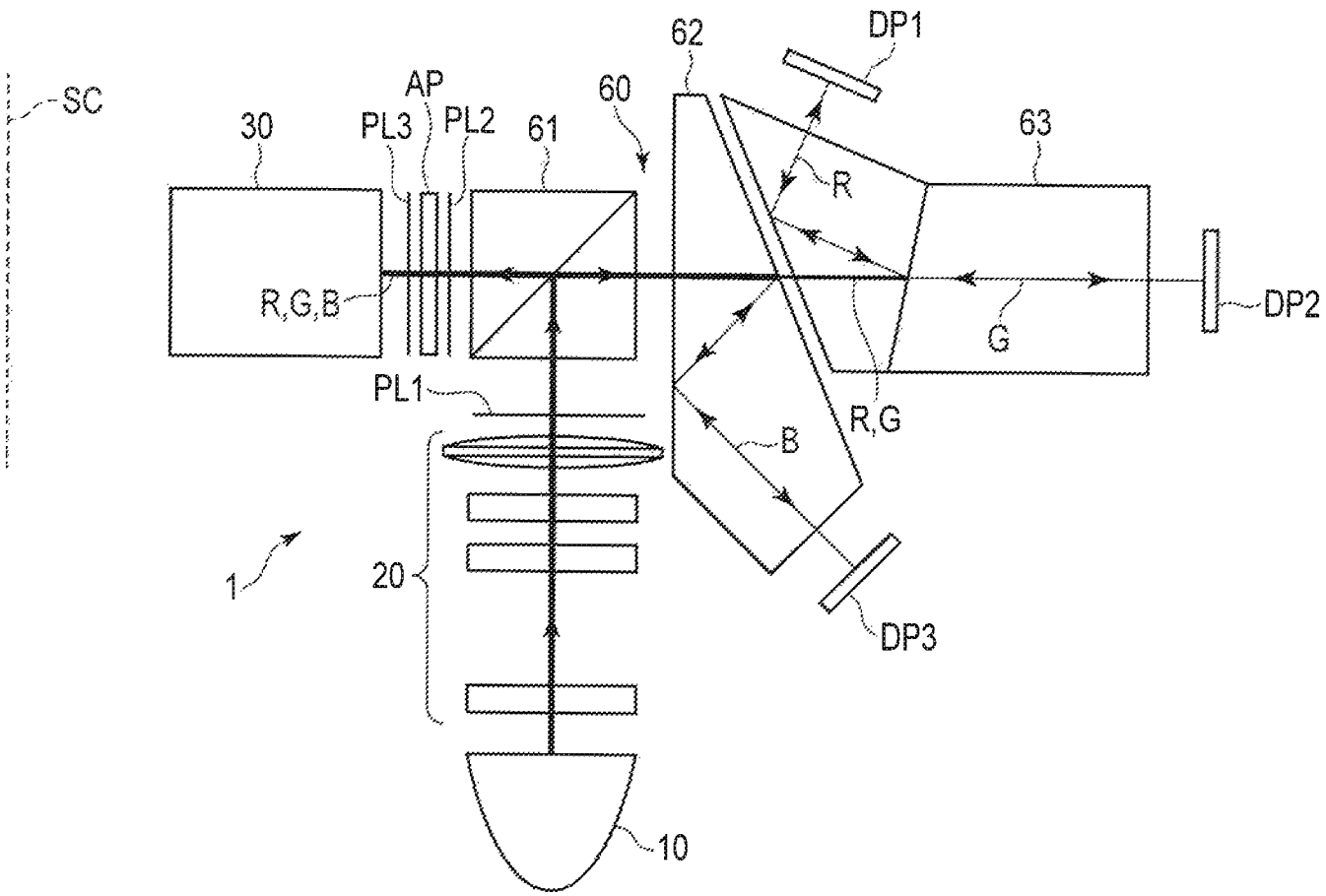
FIG. 10 is an illustration schematically showing another configuration example of the display device 1 of the embodiment.

In the display devices 1 shown in FIG. 8 and FIG. 9, the dimming panel AP may be arranged between the display panel DP and the projecting optical system 30. For example, the configuration example shown in FIG. 10 is different from the configuration example in FIG. 8 with respect to a feature that the dimming panel AP and the second polarizer PL2 are arranged between the first optical system 61 and the projecting optical system 30. In the configuration example shown in FIG. 9, the dimming panel AP and the second polarizer PL2 may be arranged between the cross dichroic prism 79 and the projecting optical system 30 though not shown in the drawing.

In this configuration example, too, the same advantages as those of the above-described configuration examples can be obtained.

According to the embodiments, as described above, the display device capable of improving the display quality can be provided.

Examples of the display device which can be obtained from the configurations described in the present specification will be hereinafter explained.

(1) A display device comprising: a light source; a dimming panel which comprises a dimming area including sub-areas arrayed in a matrix and controls a transmittance of light from the light source in each of the sub-areas; and a display panel which comprises a display area including pixels arrayed in a matrix and displays an image due to incident light transmitted through the dimming panel thereon.

(2) The display device of (1), comprising a projecting optical system which enlarges and projects the image displayed on the display panel.

(3) The display device of any one of (1) and (2), wherein the display panel comprises a first substrate, a second substrate comprising a color filter layer opposed to the first substrate, and a liquid crystal layer interposed between the first substrate and the second substrate.

(4) The display device of any one of (1) and (2), comprising a optical separation system which is arranged between the dimming panel and the display panel and which separates the light from the light source into a first wavelength band, a second wavelength band shorter than the first wavelength band, and a third wavelength band shorter than the second wavelength band, wherein the display panel comprises a first liquid crystal panel on which light of the first wavelength band is made incident, a second liquid crystal panel on which light of the second wavelength band is made incident, and a third liquid crystal panel on which light of the third wavelength band is made incident.

(5) The display device of any one of (1) to (4), wherein the dimming panel AP is a color-filterless liquid crystal panel.

(6) The display device of any one of (1) to (5), comprising a first polarizer arranged between the light source and the dimming panel, a second polarizer arranged between the dimming panel and the display panel, and a third polarizer arranged between the display panel and a screen, wherein the second polarizer functions as an analyzer for the dimming panel and as a polarizer for the display panel.

(7) The display device of any one of (1) to (6), comprising a controller which produces a first control signal for controlling each of the sub-areas on the dimming panel, based on luminance distribution of image data, and a second control signal for controlling each of the pixels on the display panel, based on the image data.

(8) The display device of any one of (1) to (7), wherein a size of the sub-area is larger than a size of the pixel.

(9) The display device of (8), wherein a dark pattern and a bright pattern having a higher transmittance than the dark pattern are displayed on the dimming area, and a dark portion corresponding to the dark pattern, a bright portion having a higher transmittance than the dark portion and corresponding to the bright pattern, and a complementary portion which is located between the dark portion and the bright portion and which corresponds to the bright pattern, are displayed on the display area.

(10) The display device of (9), wherein a transmittance of the complementary portion is lower than a transmittance of the dark portion.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a light source;

a dimming panel which comprises a dimming area including sub-areas arrayed in a matrix and controls a transmittance of light from the light source in each of the sub-areas;

a display panel which comprises a display area including pixels arrayed in a matrix and displays an image due to incident light transmitted through the dimming panel thereon; and an optical separation system which is arranged between the dimming panel and the display panel and which separates the light from the light source into a first wavelength band, a second wavelength band shorter than the first wavelength band, and a third wavelength band shorter than the second wavelength band, wherein the display panel comprises a first liquid crystal panel on which light of the first wavelength band is made incident, a second liquid crystal panel on which light of the second wavelength band is made incident, and a third liquid crystal panel on which light of the third wavelength band is made incident.

2. The display device according to claim 1, further comprising a projecting optical system which enlarges and projects the image displayed on the display panel.

3. The display device according to claim 1, wherein the display panel comprises a first substrate, a second substrate comprising a color filter layer opposed to the first substrate, and a liquid crystal layer interposed between the first substrate and the second substrate.

4. The display device according to claim 1, wherein the dimming panel is a color-filterless liquid crystal panel.

5. The display device according to claim 1, further comprising a controller which produces a first control signal for controlling each of the sub-areas on the dimming panel, based on luminance distribution of image data, and a second control signal for controlling each of the pixels on the display panel, based on the image data.

6. A display device comprising:

a light source;

a dimming panel which comprises a dimming area including sub-areas arrayed in a matrix and controls a transmittance of light from the light source in each of the sub-areas;

a display panel which comprises a display area including pixels arrayed in a matrix and displays an image due to incident light transmitted through the dimming panel thereon;

a first polarizer arranged between the light source and the dimming panel;

a second polarizer arranged between the dimming panel and the display panel; and a third polarizer arranged between the display panel and a screen, wherein the second polarizer functions as an analyzer for the dimming panel and as a polarizer for the display panel.

7. A display device comprising:

a light source;

a dimming panel which comprises a dimming area including sub-areas arrayed in a matrix and controls a transmittance of light from the light source in each of the sub-areas; and a display panel which comprises a display area including pixels arrayed in a matrix and displays an image due to incident light transmitted through the dimming panel thereon;

wherein a size of the sub-area is larger than a size of the pixel, a dark pattern and a bright pattern having a higher transmittance than the dark pattern are displayed on the dimming area, and a dark portion corresponding to the dark pattern, a bright portion having a higher transmittance than the dark portion and corresponding to the bright pattern, and a complementary portion which is located between the dark portion and the bright portion and which corresponds to the bright pattern, are displayed on the display area.

8. The display device according to claim 7, wherein a transmittance of the complementary portion is lower than a transmittance of the dark portion.

* * * * *